US007663456B2

(12) United States Patent
Subramanian et al.

(10) Patent No.: US 7,663,456 B2
(45) Date of Patent: Feb. 16, 2010

(54) MICRO-ELECTROMECHANICAL SYSTEM (MEMS) SWITCH ARRAYS

(75) Inventors: Kanakasabapathi Subramanian, Clifton Park, NY (US); William James Premerlani, Scotia, NY (US); Ahmed Elasser, Latham, NY (US); Stephen Daley Arthur, Glenville, NY (US); Somashekhar Basavaraj, Karnataka (IN)

(73) Assignee: General Electric Company, Niskayuna, NY (US)

( * ) Notice: Subject to any disclaimer, the term of this patent is extended or adjusted under 35 U.S.C. 154(b) by 341 days.

(21) Appl. No.: 11/303,157

(22) Filed: Dec. 15, 2005

(65) Prior Publication Data

US 2007/0139145 A1 Jun. 21, 2007

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,757,319 | A * | 5/1998 | Loo et al. | 342/375 |
| 6,366,186 | B1 | 4/2002 | Hill et al. | 335/78 |
| 6,433,657 | B1 | 8/2002 | Chen | 333/262 |
| 6,741,207 | B1 * | 5/2004 | Allison et al. | 342/371 |
| 6,940,363 | B2 * | 9/2005 | Zipper et al. | 333/103 |

* cited by examiner

*Primary Examiner*—Elvin G Enad
*Assistant Examiner*—Bernard Rojas
(74) *Attorney, Agent, or Firm*—Patrick K. Patnode

(57) ABSTRACT

A micro-electromechanical system (MEMS) switch array for power switching includes an input node, an output node, and a plurality of MEMS switches, wherein the input node and the output node are independently in electrical communication with a portion of the plurality of MEMS switches, and wherein a failure of any one of the plurality of MEMS switches does not render ineffective another MEMS switch within the MEMS switch array.

15 Claims, 4 Drawing Sheets

MICRO-ELECTROMECHANICAL SYSTEM (MEMS) SWITCH ARRAYS

BACKGROUND

The present disclosure relates generally to the field of micro-electromechanical system (MEMS) devices and, more particularly, to MEMS switches and associated switch arrays.

Micro-electromechanical systems have been exploited as viable alternatives for existing electromechanical devices such as relays, actuators, valves and sensors. MEMS devices are potentially low cost devices, due to the use of microelectronic fabrication techniques. New functionality may also be provided because MEMS devices can be dimensionally smaller than existing electromechanical devices.

Many potential applications of MEMS technology utilize MEMS actuators. For example, many sensors, valves and positioners use actuators for movement. If properly designed, MEMS actuators can produce useful forces and displacement, while consuming reasonable amounts of power. MEMS actuators, in the form of micro-cantilevers, have been used to apply rotational mechanical force to rotate micromachined springs and gears. Piezoelectric forces have also been employed to controllably move micro-machined structures. Additionally, controlled thermal expansion of actuators or other MEMS-based components has been used to create forces for driving micro-devices.

Micro-machined MEMS electrostatic devices, which use electrostatic forces to operate electrical switches and relays, have also been created. Various MEMS relays and switches have been developed with relatively rigid cantilever members, or flexible flaps separated from an underlying substrate in order to make and break electrical connections.

Many MEMS switches have inherently low current carrying capacity in the closed position and can tolerate only a small voltage in the open position, which makes these switches more susceptible to damage than macroscopic mechanical switches. Recently, arrays of MEMS switches have been used to divide the current, voltage, or both across a number of MEMS switches. A series configuration would divide voltage and a parallel configuration would divide current. However, these MEMS arrays are substantially impacted by the failure of individual MEMS switches, which limits the usefulness of the overall arrays.

Despite their suitability for their intended purposes, there nonetheless remains a need in the art for improved MEMS arrays. It would be particularly advantageous if these MEMS arrays were more tolerant of failure of an individual MEMS switch. It would be further advantageous if such arrays continued to operate as intended despite the failure of more than one MEMS switch in either the short circuit or open circuit mode of failure.

SUMMARY

Exemplary embodiments include a micro-electromechanical system (MEMS) switch array including an input node, an output node, and a plurality of MEMS switches, wherein the input node and the output node are independently in electrical communication with a portion of the plurality of MEMS switches, and wherein a failure of any one of the plurality of MEMS switches does not render ineffective another MEMS switch within the MEMS switch array.

Exemplary embodiments also include a method for power switching using MEMS including connecting a plurality of MEMS switches to form a MEMS switch array, and connecting the MEMS switch array to an input node and an output node, wherein, upon activation of the plurality of MEMS switches, failure of any one of the plurality of MEMS switches does not render ineffective another MEMS switch within the MEMS switch array.

Exemplary embodiments further include a micro-electromechanical system (MEMS) switch array including: a first plurality of MEMS switches coupled in a first series circuit; a second plurality of MEMS switches coupled in a second series circuit; and at least one MEMS switch coupled in parallel between the first and second series circuits wherein a failure of any one of the MEMS switches does not render ineffective any other MEMS switch.

Other systems, methods, and/or computer program products according to exemplary embodiments will be or become apparent to one with skill in the art upon review of the following drawings and detailed description. It is intended that all such additional systems, methods, and/or computer program products be included within this description, be within the scope of the present disclosure, and be protected by the accompanying claims.

BRIEF DESCRIPTION OF THE DRAWINGS

Referring now to the figures, which are exemplary embodiments and wherein like elements are numbered alike.

DETAILED DESCRIPTION

Figure 1:
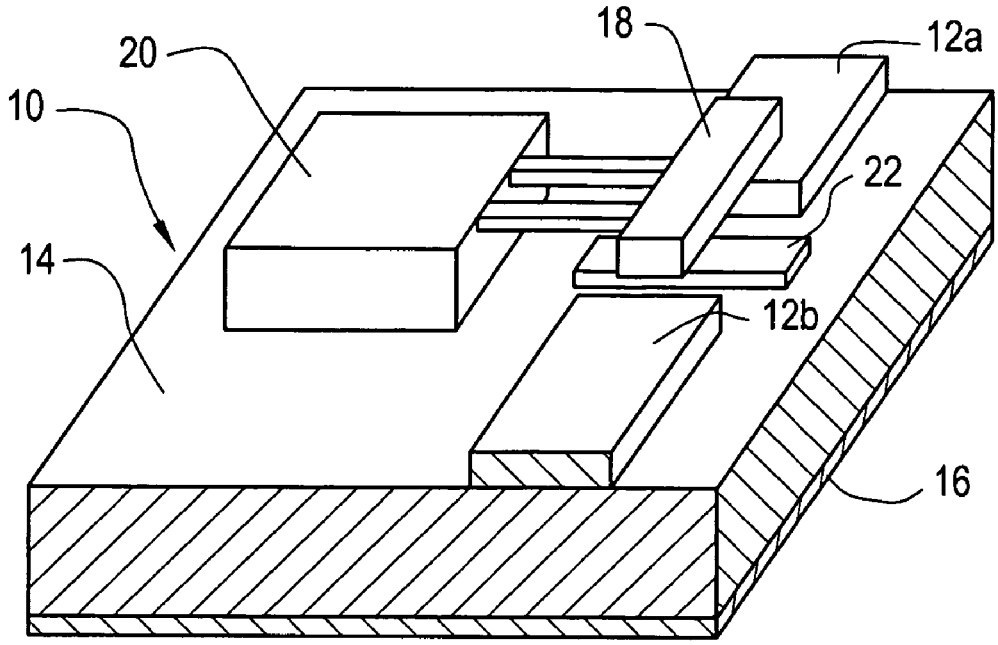
FIG. 1 PRIOR ART
FIG. 1 is a perspective view showing the structure of an example MEMS switch according to the prior art.
Figure 2:
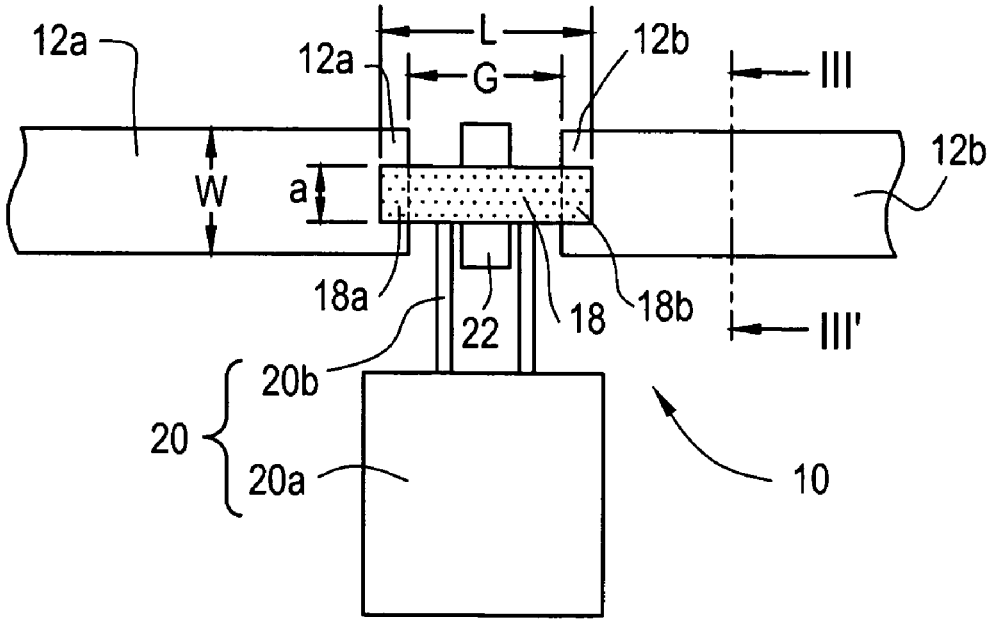
FIG. 2 PRIOR ART
FIG. 2 is a cross-sectional view of the MEMS switch shown in FIG. 1.

Referring now to the Figures, a perspective view of the structure of a MEMS switch is shown in FIG. 1. In addition, FIG. 2 is a cross-sectional view of the MEMS switch shown in FIG. 1. As used herein, the terms "series" and "parallel" have their ordinary meaning in the electronic arts. More specifically, with regard to the arrays disclosed herein, "series" is meant that a switch is in a series path from one side of the array to the other; and "parallel" is meant that a switch provides a way to bypass other switches that have failed open. Additionally, it is assumed that some of the switches may fail open or closed. An open failure, as used herein refers to a switch that has failed in an open or non-conducting position and a closed failure refers to a switch that has failed in a closed or short position.

As shown in FIG. 1, a MEMS switch 10 comprises a switch movable element 18, support structure 20, and switch electrode (driving means) 22. The MEMS switch 10 is formed on a dielectric substrate 14 together with two RF microstrip lines (distributed constant lines) 12*a* and 12*b*. A ground (GND) plate 16 is disposed on the lower surface of the dielectric substrate 14. The microstrip lines 12*a* and 12*b* are closely disposed apart from each other at a gap G. The width of each microstrip line (12*a* and 12*b*) is W.

The switch electrode 22 is disposed between the microstrip lines 2*a* and 2*b* on the dielectric substrate 14. The switch electrode 22 is formed to have a height lower than that of each of the microstrip lines 12*a* and 12*b*. A driving voltage is selectively applied to the switch electrode 22 on the basis of an electrical signal. The switch movable element 18 is arranged above the switch electrode 22. The switch movable element 18 is made of a conductive member. A capacitor structure is therefore formed by the switch electrode 22 and switch movable element 18 opposing each other.

The support structure 20 for supporting the switch movable element 18 includes a post portion 20*a* and an arm portion 20*b*. The post portion 20*a* is fixed on the dielectric substrate 14 apart from the gap G between the microstrip lines 12*a* and 12*b* by a selected distance. The arm portion 20*b* extends from one end of the upper surface of the post portion 20*a* to the gap G. The support structure 20 is made of a dielectric, semiconductor, or conductor. The switch movable element 18 is fixed on a distal end of the arm portion 20*b* of the support structure 20.

As shown in FIG. 2, the switch movable element 18 has a length L that is larger than the gap G. With this structure, distal end portions 18*a* and 18*b* of the switch movable element 18 oppose parts of distal end portions 12*a* and 12*b* of the microstrip lines 12*a* and 12*b*, respectively. The distal end portions 18*a* and 18*b* of the switch movable element 18 are defined as portions each extending by a length (L−G)/2 from a corresponding one of the two ends of the switch movable element 18. The distal end portions 12*a* and 12*b* of the microstrip lines 12*a* and 12*b* are defined as portions each extending by a length (L−G)/2 from a corresponding one of opposing ends of the microstrip lines 12*a* and 12*b*.

A width a of the switch movable element 18 is smaller than the width W of each of the microstrip lines 12*a* and 12*b*. The area of each of the distal end portions 18*a* and 18*b* of the switch movable element 18 is therefore smaller than that of each of the distal end portions 12*a* and 12*b* of the microstrip lines 12*a* and 12*b*.

Figure 3A:
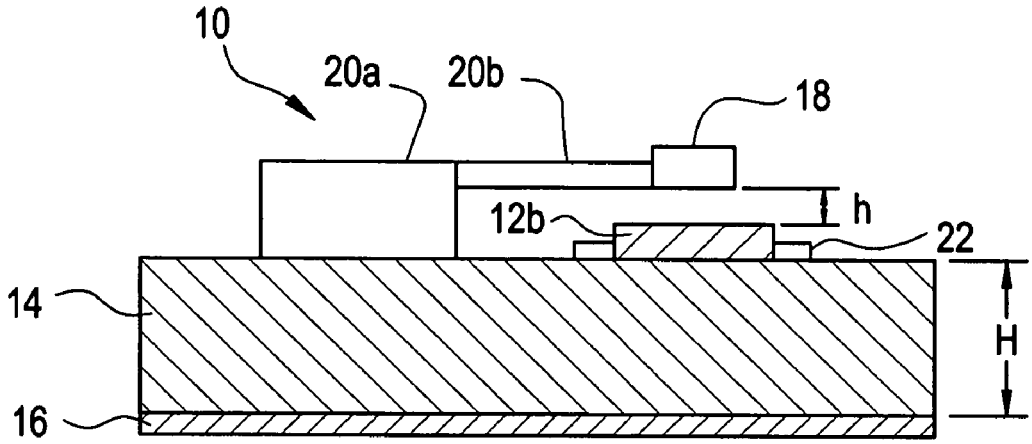
FIG. 3A PRIOR ART
FIG. 3 illustrates sectional views along line III-III' of the MEMS switch of FIG. 2 in (a) the OFF state and (b) the ON state.
Figure 3B:
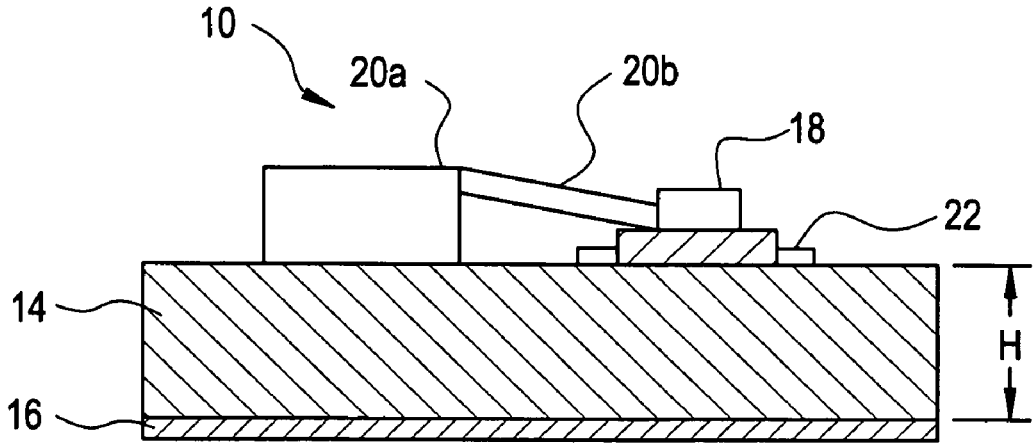
FIG. 3B PRIOR ART

FIG. 3 illustrates sectional views taken along the line III-III' of the MEMS switch 10 shown in FIG. 2, in (a) the OFF state, and (b) the ON state. As shown in FIG. 3(*a*), the switch movable element 18 is generally positioned at a portion apart from the microstrip lines 12*a* and 12*b* by a height h. In this case, the height h is approximately several micrometers (μm). If, therefore, no driving voltage is applied to the switch electrode 22, the switch movable element 18 is not in contact with the microstrip lines 12*a* and 12*b*.

However, the switch movable element 18 has the portions opposing the microstrip lines 12*a* and 12*b*. Since a capacitor structure is formed at these portions, the microstrip lines 12*a* and 12*b* are coupled to each other through the switch movable element 18. A capacitance between the switch movable element 18 and the microstrip lines 12*a* and 12*b* is proportional to the opposing area between the switch movable element 18 and microstrip lines 12*a* and 12*b*.

The switch movable element 18 is formed to have the width a smaller than the width W of each of the microstrip lines 12*a* and 12*b*, thereby decreasing the opposing area and the capacitance formed between the switch movable element 18 and microstrip lines 12*a* and 12*b*. Since this weakens the coupling between the microstrip lines 12*a* and 12*b*, energy leakage can be suppressed in the OFF state of the MEMS switch 10.

The MEMS switch 10 described above in FIGS. 1-3 is merely an exemplary embodiment of the construction of a MEMS switch. It will be appreciated by those of ordinary skill in the art that the MEMS switch as described herein may be constructed in various other configurations. For example, the support structure 20 may include a membrane, a cantilever, a deflectable membrane, a diaphragm, a flexure member, a cavity, a surface micro-machined structure, a comb structure, a bridge, or the like. In exemplary embodiments where a membrane is used, the rest position of the membrane may correspond to the OFF/ON state, and any deflection experienced by the membrane may cause the switch to flip to the opposite state.

Figure 4:
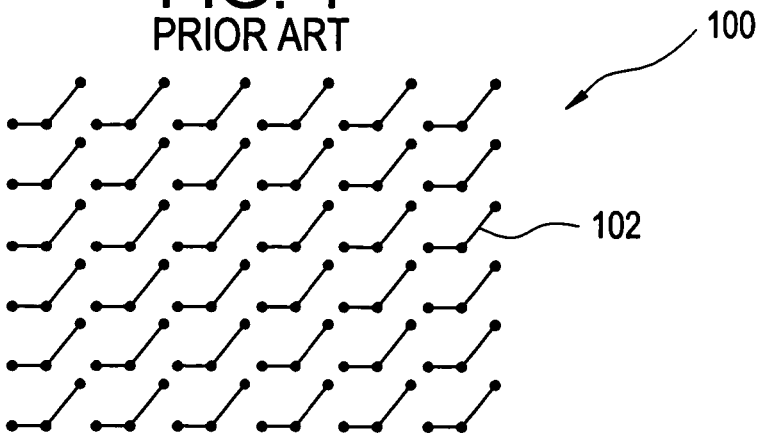
FIG. 4 PRIOR ART
FIG. 4 depicts a prior art MEMS switch array.

Referring to FIG. 4, an existing MEMS switch array is depicted generally as 100. The MEMS switch array 100 includes a parallel combination of several MEMS switches 102 in series. The MEMS switch array 100 can be used to divide the current that would otherwise flow through each MEMS switch 102 and to reduce the voltage that would otherwise be present across each MEMS switch 102. In the MEMS switch array 100, if a single MEMS switch 102 fails in the closed position, the operation of the MEMS array is not affected because the current would still flow through the closed switch. However, if a single switch 102 fails in the open position an entire row (or series combination) of MEMS switches becomes inoperable. The loss of an entire row of MEMS switches can have a large impact on the current through and the voltage across the MEMS switches 102 in the rows of the MEMS switch array 100 that do not have an open failure. However, if a single MEMS switch 102 fails in the closed position, the operation of the MEMS array is not immediately affected because the current would still flow through the closed switch and other switches would interrupt current flow when necessary. However, the failure of a single switch slightly increases the voltage applied to some of the remaining switches.

Figure 5:
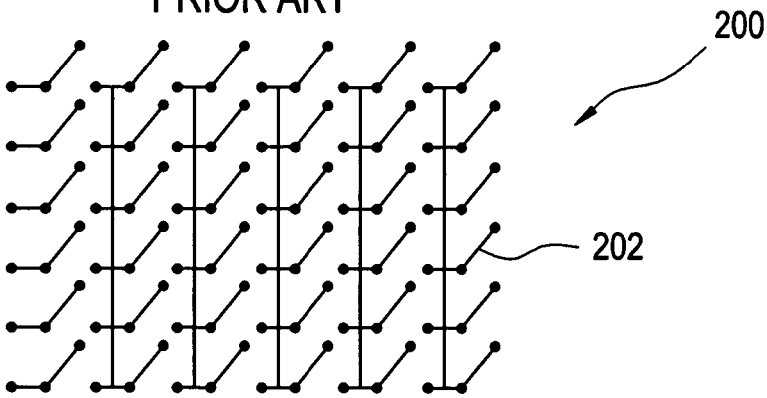
FIG. 5 PRIOR ART
FIG. 5 depicts an alternative prior art MEMS switch array.

Turning now to FIG. 5, a different MEMS switch array is depicted generally as 200. The MEMS switch array 200 includes a series combination of several MEMS switches 202 in parallel. The MEMS switch array 200 can be used to divide the current flowing through each MEMS switch 202, by utilizing a parallel arrangement of the MEMS switches 202, and to reduce the voltage across each MEMS switch 202, by utilizing a series arrangement of the MEMS switches 202. To open the MEMS switch array 200, all MEMS switches 202, both series and parallel, are opened; and to close the MEMS switch array 200, all MEMS switches 202 are closed. In MEMS switch array 200, if a single switch 202 fails in the open position the operation of the MEMS array 200 is not immediately affected, though the current increases slightly through some of the switches in the array as a result. However, if a single MEMS switch 202 fails in the closed position, an entire column (or parallel combination) of MEMS switches 202 becomes inoperable because the closed failure provides a short circuit path around the MEMS switches in the column. The loss of an entire column of MEMS switches 202 can have a large impact on the current through, and the voltage across, the MEMS switches 202 in the columns of the MEMS switch array 200 that do not have an open failure.

Figure 6:
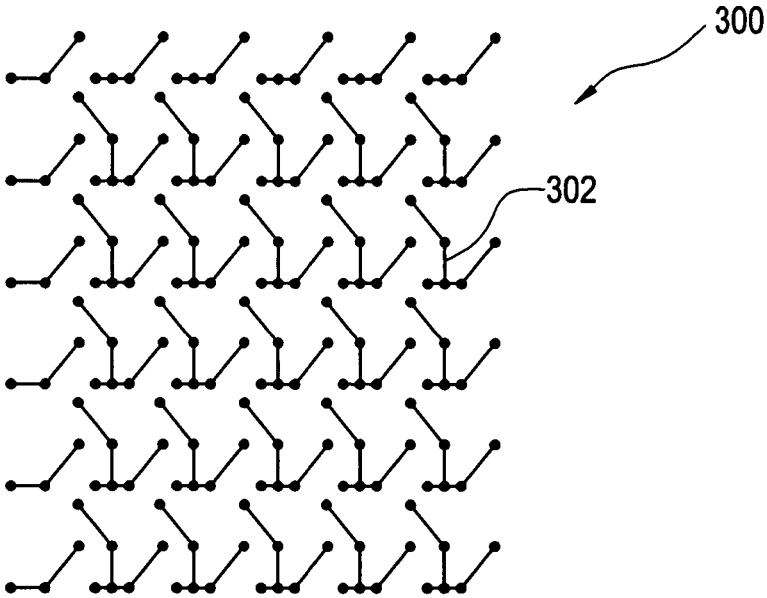
FIG. 6 depicts an exemplary embodiment of a MEMS switch array for power switching according to the present disclosure.

Referring now to FIG. 6, another MEMS switch array in accordance with one embodiment is depicted generally as 300. The MEMS switch array 300 includes both series and parallel combinations of a plurality of switches 302. The MEMS switch array 300 can be used to divide the current flowing through each MEMS switch 302 and to reduce the voltage across each MEMS switch 302. In one embodiment, to open the MEMS switch array 300, all MEMS switches 302, both series and parallel, are opened; and to close the MEMS switch array 300, all MEMS switches 302 are closed. The configuration of the MEMS array 300 is such that if a single switch 302 fails in either the open or closed position neither an entire row, nor an entire column is rendered ineffective. The configuration of the MEMS array 300 allows the failure of any one MEMS switch 302 to be isolated and not render other MEMS switches 302 ineffective. A MEMS switch 302 is considered to be ineffective if its proper operation does not impact the operation of the MEMS array 300. For example as illustrated in MEMS array 200 of FIG. 5, a closed failure of a first MEMS switch 202 will short all other MEMS switches connected in parallel with the first MEMS switch thereby rendering those switches ineffective. Further as illustrated in MEMS array 100 of FIG. 4, an open failure of a first MEMS switch 102 will prevent current from flowing through an entire row of series MEMS switches 102 thereby rendering the remainder of the switches in the row ineffective. The operation of the MEMS arrays 300 is therefore more tolerant of failures of individual switches 302 than are either of the prior art MEMS array 100 or the MEMS array 200 because the failure of a single MEMS switch 302 does not necessarily render ineffective any other MEMS switch 302.

The failure of a single MEMS switch 302 will have a minimal impact on the current through and the voltage across the remaining MEMS switches 302 and therefore will not substantially affect the operation of the MEMS array 300. Since the failure of a single MEMS switch 302 is isolated, it does not have a cascading effect of the rest of the MEMS switches 302 in the MEMS array 300. The MEMS array 300 will continue to function as intended until a critical number of MEMS switches 302 fail in either the open or closed position such that the current flowing through the remaining viable paths in the MEMS array 300 overloads the capacity of the individual MEMS switch 302 thereby resulting in the cascading failure of the remaining MEMS switches 302 in the MEMS array 300. The critical number is defined as the number of MEMS switches 302 that must fail before the current flowing through the remaining viable paths in the MEMS array 300 overloads the capacity of the individual MEMS switches 302. Once a critical number of MEMS switches 302 of the MEMS array 300 fail, the MEMS array 300 experiences a complete failure, i.e. it is no longer operable as a switch.

Figure 7:
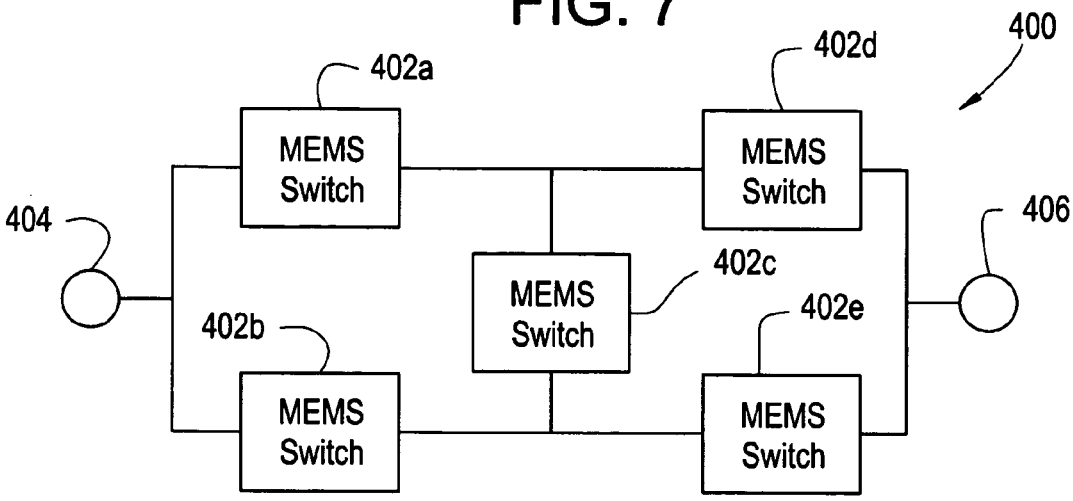
FIG. 7 depicts a portion of a MEMS switch array in accordance with FIG. 6.

FIG. 7 illustrates an exemplary embodiment of a portion of a MEMS switch array 400 in accordance with FIG. 6. As shown in FIG. 7 the MEMS array 400 includes five MEMS switches 402(*a*)-(*e*), an input node 404, and an output node 406. To open the MEMS switch array 400, all MEMS switches 402(*a*)-(*e*), both series and parallel, are opened; and to close the MEMS switch array 400, all MEMS switches 402(*a*)-(*e*) are closed. The configuration of the MEMS switch array 400 includes two MEMS switches 402(*a*) and (*b*) connected in parallel to the input node 404 and to the MEMS switch 402(*c*). The configuration of the MEMS switch array 400 also includes two MEMS switches 402(*d*) and (*e*) connected in parallel to the output node 406 and to the MEMS switch 402(*c*). The MEMS switches 402 are arranged such that a failure by a single MEMS switch in either the open or closed position will not affect the operation of the MEMS switch array 400. The MEMS switches used in the MEMS switch arrays 400 may be any type of MEMS switch and may also include graded MEMS switches.

FIG. 7 depicts only five MEMS switches 402(*a*)-(*e*) in the MEMS switch array 100, for purposes of illustration. In practice, the MEMS switch array 400 will comprise many more MEMS switches 402. In the MEMS switch array, the number of parallel paths may depend on the ratio of the array current to the switch current carrying capability. For example, typically a single MEMS switch 402 can handle around 0.5 amps on a short-term overload basis. In order to handle the 6× inrush for a 10 amp motor starter 120 parallel paths will be required. The number of switches required in series is generally less, because of the better match of MEMS voltage capability to system requirements. Therefore for this application, the number of MEMS switches in the MEMS switch array is on the order of 1200 MEMS switches.

Figure 8:
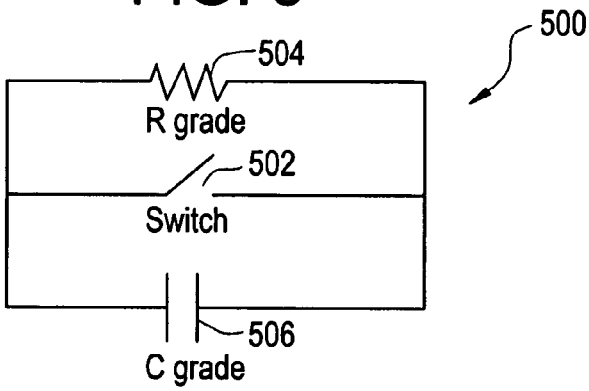
FIG. 8 depicts a graded MEMS switch.

Referring now to FIG. 8, an exemplary embodiment of a graded MEMS switch is depicted generally as 500. The graded switch 500 includes a MEMS switch 502, a grading resistor 504, and a grading capacitor 506. The grading resistor 504 is provided in parallel with each MEMS switch 502 to provide voltage grading for the network, regardless of whether any of the switches have failed in the closed or open position. In an exemplary embodiment, the grading resistance may be in the range from about 1 megohm to about 1,000,000 megohms. The grading capacitor 506 is provided in parallel with each MEMS switch 502 to provide sharing of the transient recovery voltage as the switches open in any random order. In an exemplary embodiment each MEMS switch in the MEMS switch array is a graded switch to compensate for any randomness in the sequence of opening and closing of the MEMS switches.

In an exemplary embodiment of the MEMS switch array 400, the MEMS switches 402 are graded MEMS switches 502 as shown in FIG. 8. The graded MEMS switches 502 connected in series and parallel can have the same values of grading resistance 504 and capacitance 506. In alternative exemplary embodiments, the values of the grading resistance 504 may be different between the MEMS switches. The MEMS switch array 400 can be a square array (i.e., having the same number of rows and columns) or a rectangular array (i.e. having a different number of rows and columns).

Several strategies may be used for activating and/or controlling switching of the MEMS switches 402 in the MEMS switch array 400. For example, all of the MEMS switches 402 may be activated simultaneously, resulting in a statistical distribution. Alternatively, the switches may be activated sequentially in any of two ways. A first sequential order activates the parallel switches first, followed by the series switches; and a second sequential order activates the series switches first, followed by the parallel switches.

Figure 9:
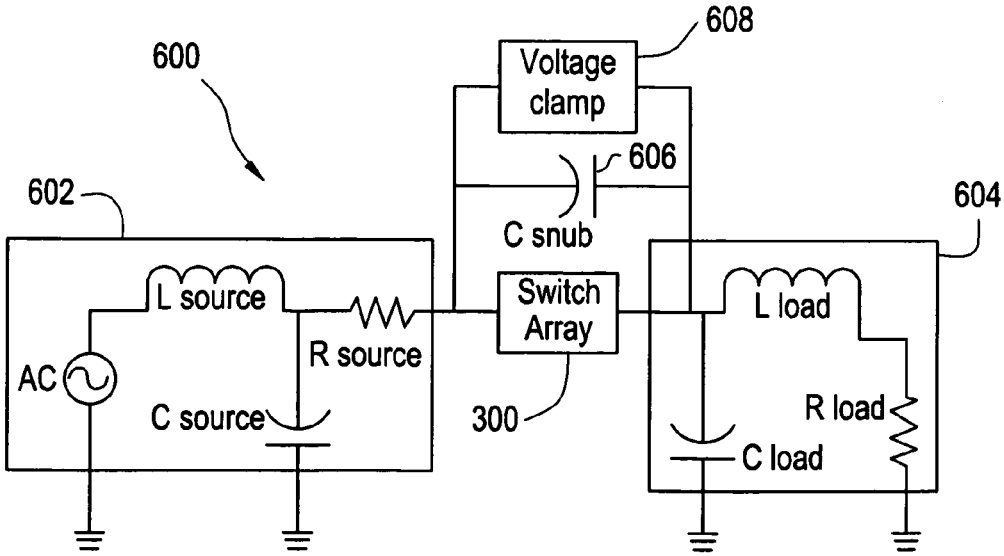
FIG. 9 depicts a block diagram of an exemplary system including a MEMS switch array.

In an exemplary embodiment, the MEMS switching array 300 may be incorporated into a power switching system 600 as shown in FIG. 9. The power switching system 600 may further include a source 602 in electrical communication with the MEMS switch array 300; a load 604 in electrical communication with the MEMS switch array 300; and a MEMS switch controller (not shown) for selectively activating the MEMS switch array 300 wherein the failure of a MEMS switch 302 will not affect the operation of the MEMS switch array 300. The MEMS switch array 300 can be in a parallel configuration with a snubber capacitor 606 and a voltage clamp 608. The snubber capacitor 606 is used to control the rate of rise of recovery voltage when the MEMS switch array 300 opens. The voltage clamp 608 is used to absorb trapped inductive energy. The voltage clamping level is set according to the same logic that is used to select voltage surge suppressors, i.e., the clamping voltage is set high enough to shut the current off against the source voltage, but not so high as to exceed the voltage rating of the switches. In exemplary embodiments, the clamping voltage and the voltage rating of the switch is set to be 1.6 times the peak source voltage. Additionally, the source can include an inductance, a resistance, and a capacitance or a combination thereof. Likewise, the load can include an inductance, a resistance, and a capacitance or a combination thereof.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A micro-electromechanical system (MEMS) switch array comprising a first plurality of graded MEMS switches coupled in a first series circuit;

a second plurality of graded MEMS switches coupled in a second series circuit; and at least one graded MEMS switch coupled in parallel between the first and second series circuits wherein a failure of any one of the graded MEMS switches is limited to the failed switch and does not cause complete failure of the graded MEMS switch array.

2. The MEMS switch array of claim 1, wherein each graded MEMS switch of the first plurality of graded MEMS switches and the second plurality of graded MEMS switches is coupled in parallel with the at least one graded MEMS switch.

3. A micro-electromechanical system (MEMS) switch array for power switching comprising:

an input node;

an output node;

a first plurality of graded MEMS switches coupled in a first series circuit;

a second plurality of graded MEMS switches coupled in a second series circuit; and at least one graded MEMS switch coupled in parallel between the first and second series circuits, wherein the input node and the output node are in electrical communication with a portion of the plurality of graded MEMS switches, and wherein a failure of any one of the plurality of graded MEMS switches is limited to the failed switch and does not affect voltage and current capabilities of the MEMS switch array.

4. The MEMS switch array of claim 3, wherein the input node is in electrical communication with a first and a second graded MEMS switch that are part of at least one plurality of graded MEMS switches, and wherein the first and second graded MEMS switches are coupled in parallel with each other.

5. The MEMS switch array of claim 4 wherein the output node is in electrical communication with a third and a fourth graded MEMS switch that are part of at least one plurality of graded MEMS switches, and wherein the third and fourth MEMS switches are coupled in parallel with each other.

6. The MEMS switch array of claim 5, wherein the first graded MEMS switch and the third graded MEMS switch are coupled in series with each other.

7. The MEMS switch array of claim 6, wherein the second graded MEMS switch and the fourth MEMS switch are coupled in series with each other.

8. The MEMS switch array of claim 7, wherein a fifth MEMS switch that are part of at least one graded MEMS switch coupled in parallel is in electrical communication with the first, second, third, and fourth graded MEMS switches.

9. The MEMS switch array of claim 3, wherein the failure of multiple graded MEMS switches will not cause a complete failure of the graded MEMS switch array.

10. A method for power switching, comprising:

connecting a plurality of graded MEMS switches to form a MEMS switch array; and connecting the graded MEMS switch array to an input node and an output node, wherein, upon activation of the plurality of graded MEMS switches, failure of any one of the plurality of graded MEMS switches is limited to the failed switch and does not cause a complete failure of the functionality performed by MEMS switch array.

11. The method of claim 10, wherein the plurality of graded MEMS switches are activated simultaneously.

12. The method of claim 10, wherein the plurality of graded MEMS switches are activated in sequence.

13. The method of claim 12, wherein the MEMS switch array comprises one or more columns of graded MEMS switches in parallel and one or more rows of graded MEMS switches in series, and wherein the one or more rows of graded MEMS switches are activated before the one or more columns of graded MEMS switches.

14. The method of claim 12, wherein the MEMS switch array comprises one or more columns of graded MEMS switches in parallel and one or more rows of graded MEMS switches in series, and wherein the one or more columns of graded MEMS switches are activated before the one or more rows of graded MEMS switches.

15. The method of claim 10, wherein the failure of multiple graded MEMS switches will not cause a complete failure of the functionality performed by MEMS switch array.

* * * * *

UNITED STATES PATENT AND TRADEMARK OFFICE

CERTIFICATE OF CORRECTION

PATENT NO. : 7,663,456 B2
APPLICATION NO. : 11/303157
DATED : February 16, 2010
INVENTOR(S) : Subramanian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 432 days.

Signed and Sealed this

Twenty-eighth Day of December, 2010

David J. Kappos

David J. Kappos
*Director of the United States Patent and Trademark Office*